US007762933B1

(12) United States Patent
Yu

(10) Patent No.: US 7,762,933 B1
(45) Date of Patent: Jul. 27, 2010

(54) WEIGHT-ADJUSTABLE KETTLE-SHAPED DUMBBELL

(76) Inventor: Yu-Chen Yu, 1F., No. 16, Lane 429, Sec. 2, Dongda Rd., Hsinchu City 300 (TW)

( * ) Notice: Subject to any disclaimer, the term of this patent is extended or adjusted under 35 U.S.C. 154(b) by 45 days.

(21) Appl. No.: 12/483,326

(22) Filed: Jun. 12, 2009

(30) Foreign Application Priority Data

Feb. 17, 2009 (TW) ..... 98104896 A

(51) Int. Cl.
*A63B 21/075* (2006.01)

(52) U.S. Cl. ..... 482/107; 482/109; 482/106

(58) Field of Classification Search ..... 482/107–109, 482/110, 126, 148, 44
See application file for complete search history.

(56) References Cited

U.S. PATENT DOCUMENTS 4,529,198 A * 7/1985 Hettick, Jr. ..... 482/104
7,491,157 B1 * 2/2009 Lin ..... 482/108
2007/0135274 A1 * 6/2007 Blateri ..... 482/109
2009/0062085 A1 * 3/2009 Polevoy et al. ..... 482/93
2009/0124470 A1 * 5/2009 Yu ..... 482/107

* cited by examiner

*Primary Examiner*—Jerome Donnelly
(74) *Attorney, Agent, or Firm*—Chun-Ming Shih

(57) ABSTRACT

A weight-adjustable kettle-shaped dumbbell includes a body. The inner bottom of the body is hollow. With a selector unit, the body is able to hang a desired number of weight pieces for changing the weight of the dumbbell. The selector unit links a cable member to move upward or downward with an operating member for changing the inner and outer positions of specific selection boards in the body so as to attach relative weight pieces to the body. The kettle-shaped dumbbell of the present invention is adjustable in weight for the user's demand.

10 Claims, 8 Drawing Sheets

WEIGHT-ADJUSTABLE KETTLE-SHAPED DUMBBELL

BACKGROUND OF THE INVENTION

1. Field of the Invention

The present invention relates to a weight-adjustable kettle-shaped dumbbell, and more particularly to a kettle-shaped dumbbell which is adjustable in weight.

2. Description of the Prior Art

Conventional dumbbell has a single configuration and a fixed weight. In use, the user has to choose a suitable dumbbell according to his/her physical ability. If the selected dumbbell is too light, the user has to buy a heavier one. For the user, the light dumbbell may be useless in the future, which causes a waste. Besides, the conventional fixed weight dumbbell is unable to be used for a different user because the desired weight of the dumbbell is different. Furthermore, for the makers and sellers, various dumbbells in different weights occupy a lot of space and increase cost.

Accordingly, the inventor of the present invention has devoted himself based on his many years of practical experiences to the development of a weight-adjustable dumbbell.

SUMMARY OF THE INVENTION

The primary objective of the present invention is to provide a weight-adjustable kettle-shaped dumbbell for the user to adjust a desired weight.

In order to achieve the above objective, the present invention includes a body having a handle. The body is disposed on a base. The inner bottom of the body is hollow. With a selector unit, the body is able to hang a desired number of weight pieces for changing the weight of the dumbbell. The selector unit links a cable member to move upward or downward with an operating member for changing the inner and outer positions of specific selection boards in the body so as to attach relative weight pieces to the body.

Embodiments of the present invention will now be described, by way of example only, with reference to the accompanying drawings.

DETAILED DESCRIPTION OF THE PREFERRED EMBODIMENTS

Figure 1:
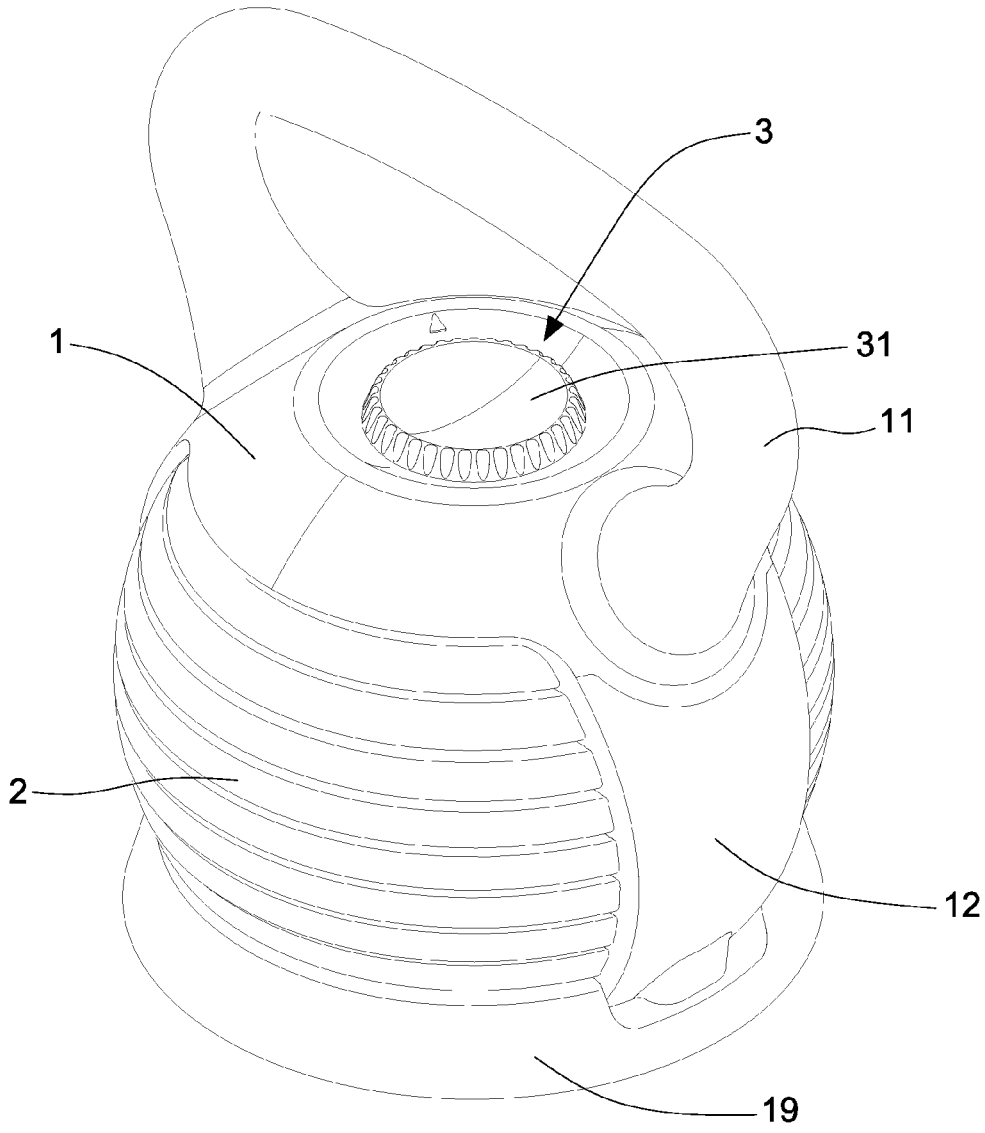
FIG. 1 is a perspective view of the present invention.
Figure 2:
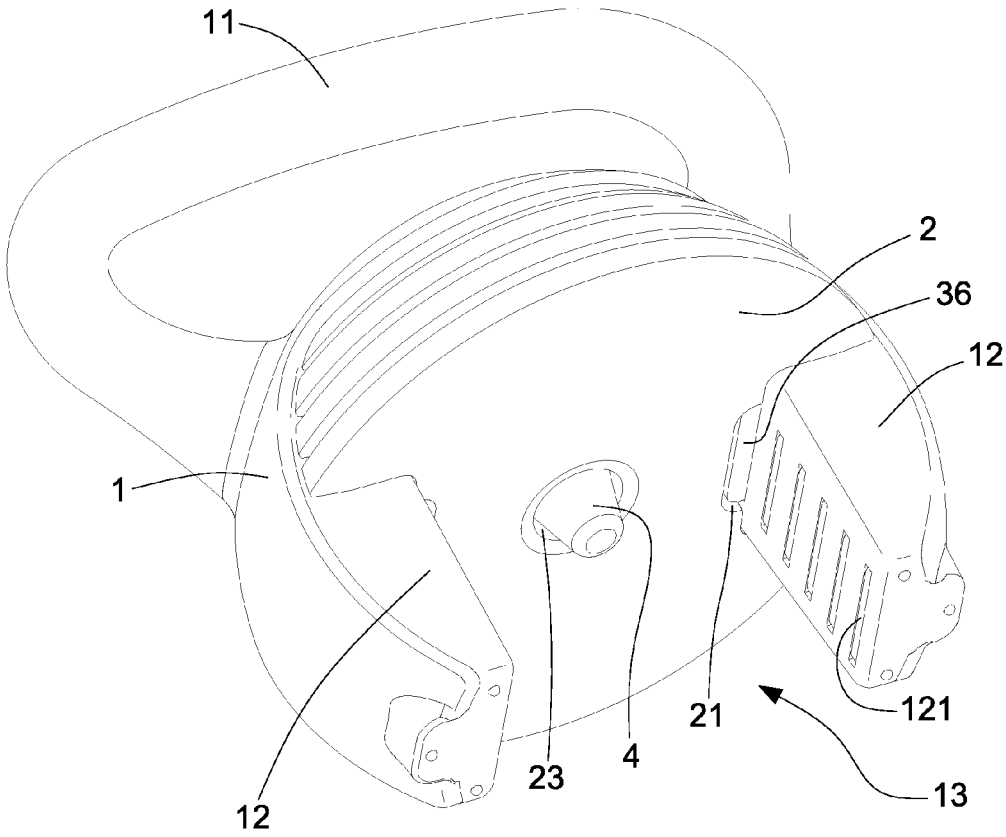
FIG. 2 is a partially perspective bottom view of the present invention.

As shown in FIGS. 1 through 4, a weight-adjustable kettle-shaped dumbbell of the present invention comprises a body 1, weight pieces 2, a selector unit 3, and conical members 4.

The body 1 has a handle 11 at the top of the body 1. The body 1 is shaped like English letter C having an opening facing downward. The body 1 has a pair of extending portions 12 extending from two sides thereof. The body 1 has a space 13 formed at an inner bottom between the two extending portions 12. Each extending portion 12 is formed with a plurality of slots 121 at an inner side thereof. The body 1 is coupled to a base 19.

The weight pieces 2 are transversely stacked in the space 13. Each weight piece 2 has a pair of notches 21 corresponding to the extending portions 12, a selection portion 22 at an inner end of each notch 21, and a central hollowed portion 23.

The selector unit 3 comprises an operating member 31 disposed on the top of the body 1. The operating member 31 is rotatable in relation to the body 1. The bottom of he operating member 31 is provided with a linking member 32 inside the body 1. The linking member 32 is connected with two cable members 33 at a specific position, respectively. The cable members 33 are flexible. Each cable member 33 has a terminal extending downward along a track 34 in a relative extending portion 12 of the body 1. Each extending portion 12 is provided with a plurality of selection boards 35 close to an inner side of a relative cable member 33. Each selection board 35 is formed with an inclined plane 351 at an outer side thereof and a selection end 36 at an inner side thereof. The selection end 36 faces the notch 121. When the inclined plane 351 of the selection board 35 is contact with the cable member 33, the selection end 36 will extend into the notch 121.

Each conical member 4 is in a reverse cone shape and coupled to the hollowed portion 23 of each weight piece 2. After stacking the weight pieces 2, the conical member 4 makes the weight pieces 2 coaxial and spaced from each other, without deviation.

To assemble the present invention, the weight pieces 2 are stacked on the base 19, and then the body 1 is placed on the top of the weight pieces 2 with the extending portions 12 corresponding in position to the notches 21 of each weight piece 2.

Figure 3:
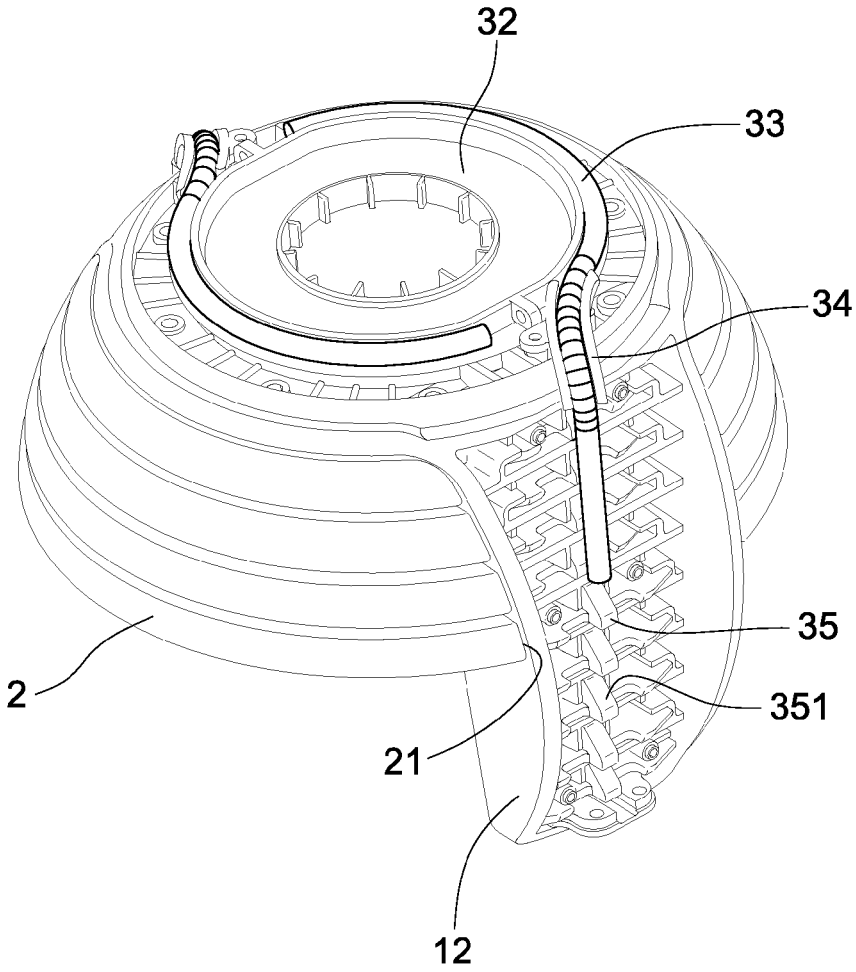
FIG. 3 is a partially perspective view of the present invention.
Figure 4:
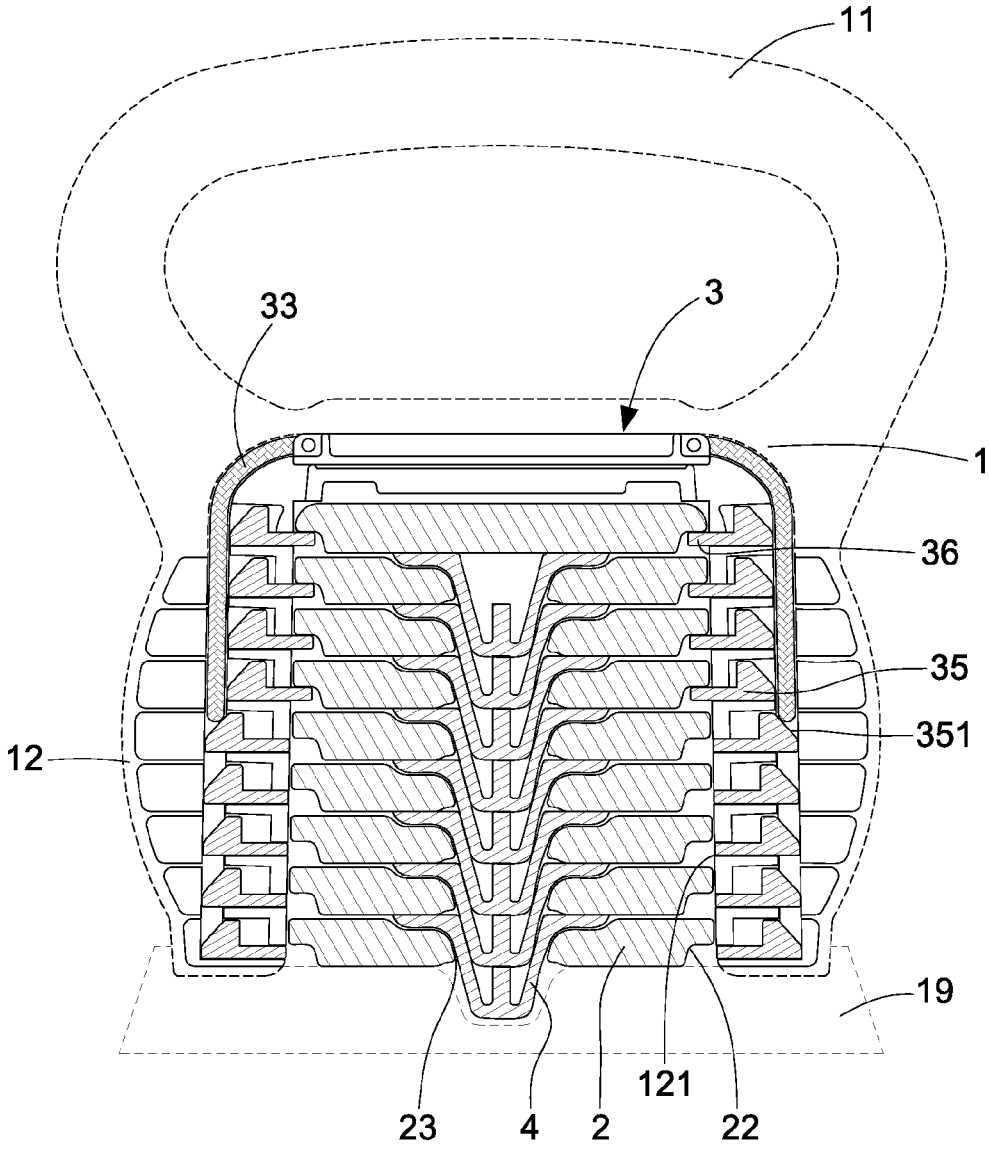
FIG. 4 is a cross-sectional view of the present invention.
Figure 5:
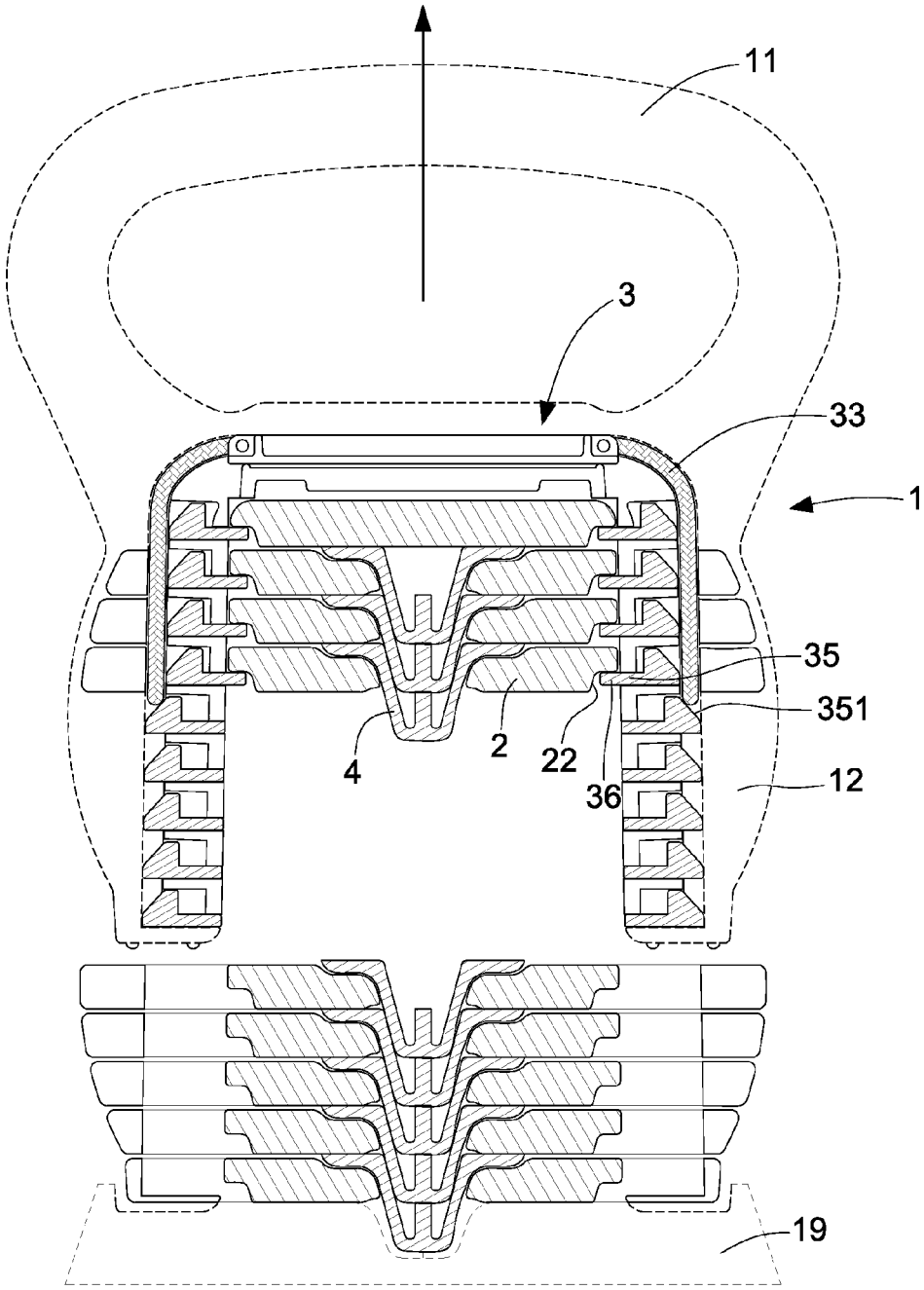
FIG. 5 is a cross-sectional view of the present invention after selecting weight pieces.

When the present invention doesn't proceed to select, the cable members 33 are rolled with their terminals located at a relative upper position. When the present invention proceeds to select, the operating member 31 will be rotated clockwise, as shown in FIGS. 1 and 3, to bring the linking member 32 such that the cable members 33 are pushed to extend downward along the tracks 34. When the cable members 33 move downward, the terminals of the cable members 33 will be contact with the inclined planes 351 of the selected selection boards 35 for urging the selection boards 35 to move inward. The selection ends 36 of the selected selection boards 35 are inserted through the slots 121 and located under the selection portions 22 of the weight pieces 2, forming the selected weight pieces 2 attached to the body 1. As shown in FIG. 5, the body 1 is lifted up to complete weight selection.

By rotating the operating member 31, the present invention is able to control the number of the weight pieces 1. When the operating member 31 is rotated more, the terminals of the cable members 33 will extend downward more for hanging more weight pieces 2. On the contrary, when the operating member 31 is rotated few, the terminals of the cable members 33 will extend downward few for hanging few weight pieces 2.

The selection board 35 is provided with a resilient member (not shown in the drawings) close to one side of the slot 121. When the cable members 33 are moved upward to disengage from the selected selection boards 35, the selected selection boards 35 will automatically return to their original positions into the slots 121.

In the aforesaid embodiment, the selector unit 3 of the present invention proceeds to select from an outer side of the weight piece 2, which may be proceeded by penetrating the weight piece.

The operating member 31 is not to be limited except in a rotating way, which may be designed in a dialing way.

Figure 6:
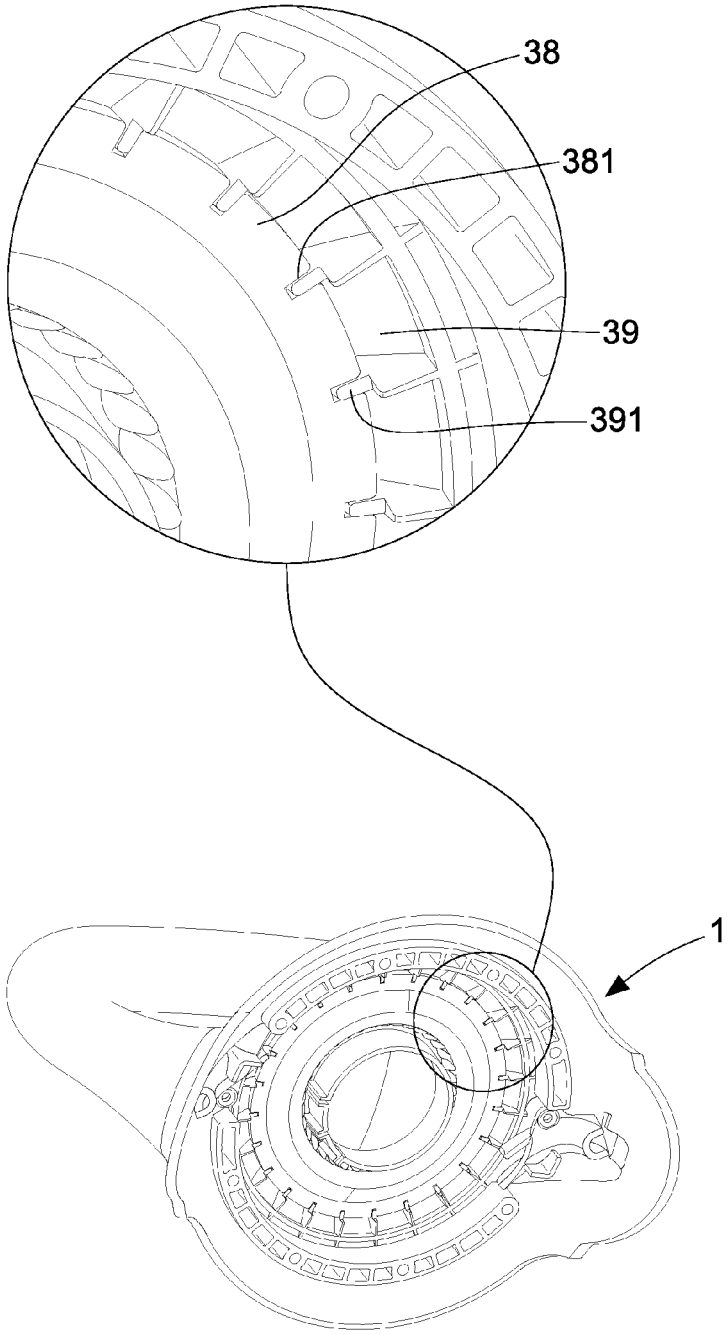
FIG. 6 is a configuration view of a security lock device of the present invention.
Figure 7:
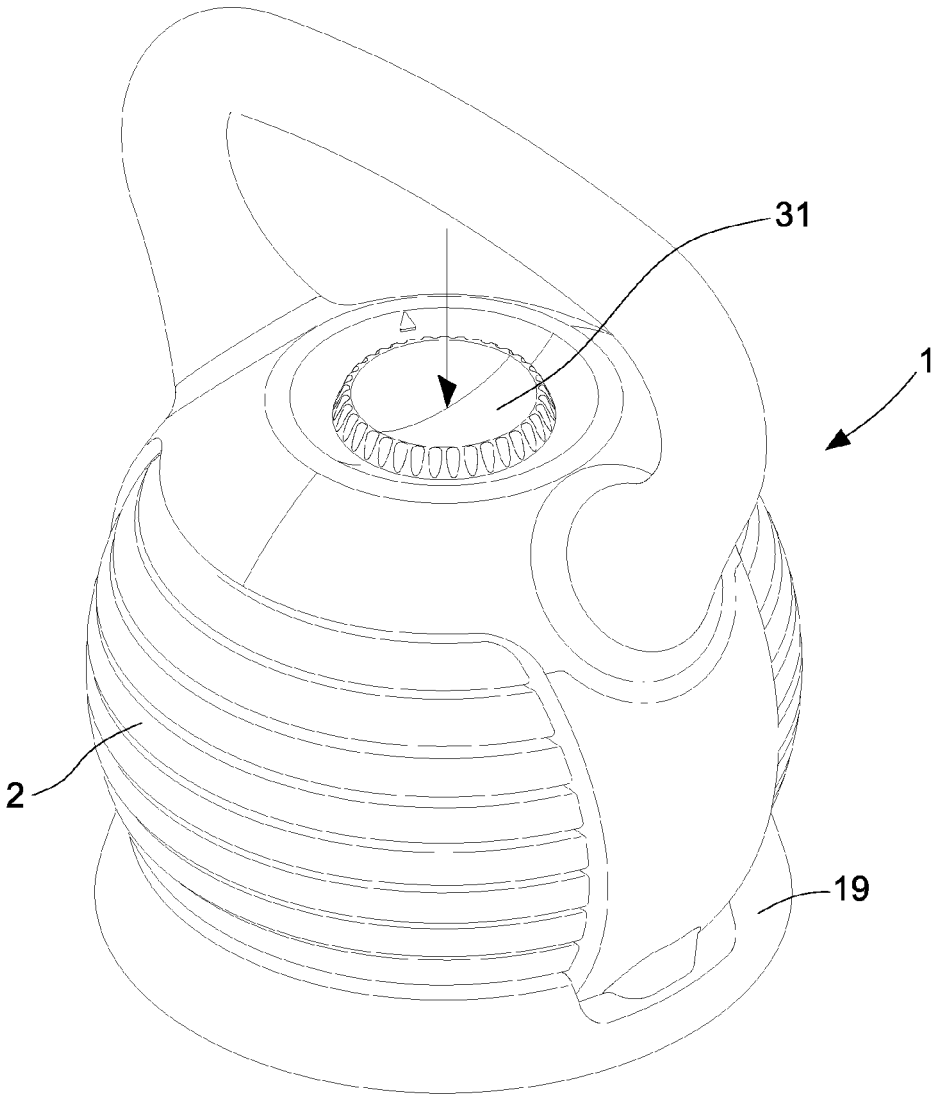
FIG. 7 is a schematic view showing the engagement of the security lock device of the present invention.
Figure 8:
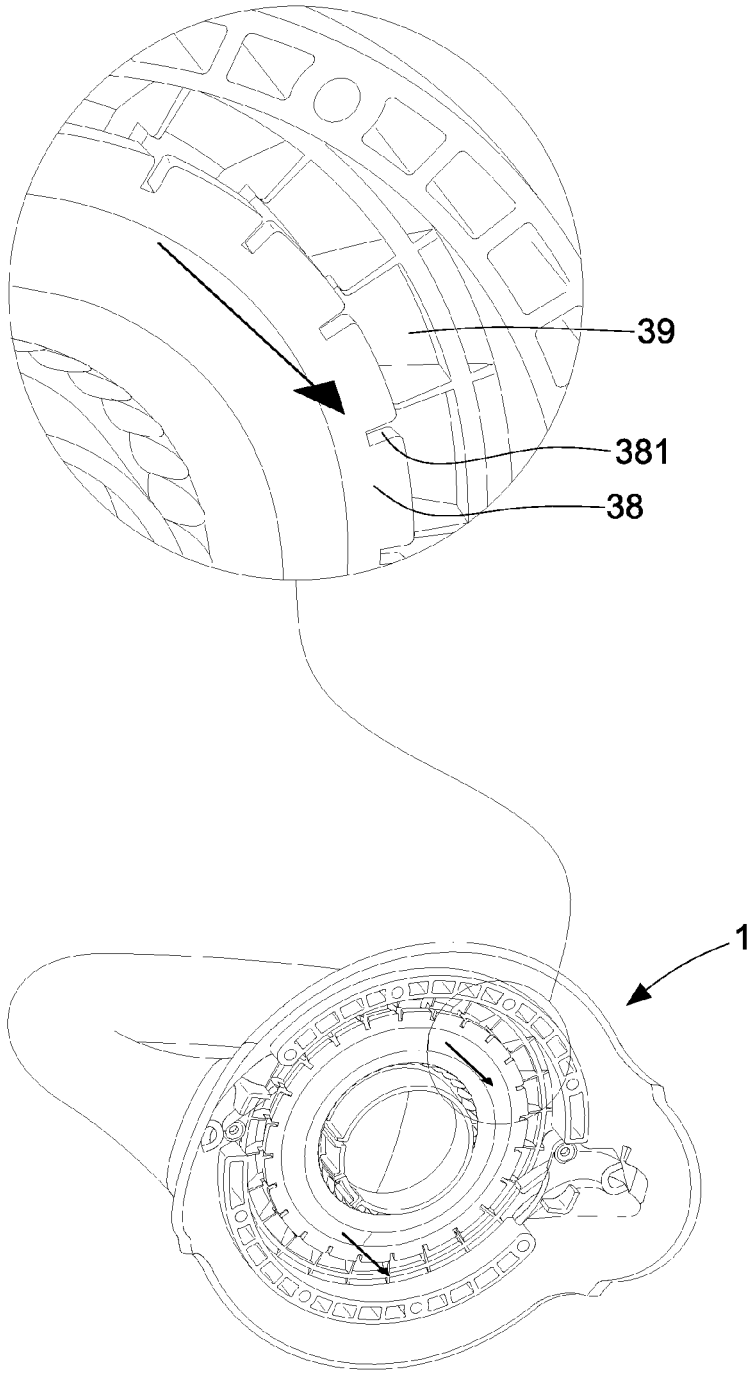
FIG. 8 is a schematic view showing the disengagement of security lock device of the present invention.

As shown in FIG. 6, in order to ensure that the selector unit 3 doesn't be operated wrongly, the present invention may be provided with a security lock device. A bottom plate 38 is provided under the linking member 32. The bottom plate 38 has a number of recesses 381 formed around its edge. The body 1 comprises a circular lid 39 at a top inner wall thereof. The circular lid 39 is formed with a number of protrusions 391. The base plate 38 and the circular lip 39 are locked with the recesses 381 engaging with the protrusions 391. As shown in FIG. 7, when the operating member 31 is pressed downward, the recesses 381 will disengage from the protrusions 391, as shown in FIG. 8, for rotating the operating member 31.

Besides, the base 19 of the present invention may be designed to have a configuration like the selection portion 22 of the weight piece 2. Thus, the base 19 may be selected together by adjusting the selector unit 3.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A weight-adjustable kettle-shaped dumbbell, comprising:

a body, having a space at a bottom thereof;

one or more weight pieces, stacked in the space of the body, each of the weight pieces having a selection portion; and a selector unit, disposed in the body, by adding the weight pieces with the selection portion to changing the connection of the body and the weight pieces, wherein the body comprises a pair of extending portions, each of the extending portions being formed with slots at an inner side thereof; each of the weight pieces being formed with a pair of notches, the selection portion being disposed at an inner end of each notch; the selector unit comprising an operating member disposed on the top of the body, the operating member being connected with a linking member, the linking member having two ends each connected with a cable member, the cable member having a terminal extending downward along a track in a relative extending portion of the body; each of the extending portions being provided with a plurality of selection boards close to an inner side of a relative cable member, each of the selection boards being formed with an inclined plane at an outer side thereof and a selection end at an inner side thereof, the selection end facing a relative notch.

2. The weight-adjustable kettle-shaped dumbbell as claimed in claim 1, wherein the body is provided with a handle.

3. The weight-adjustable kettle-shaped dumbbell as claimed in claim 1, wherein the body is coupled to a base.

4. The weight-adjustable kettle-shaped dumbbell as claimed in claim 1, wherein each of the weight pieces is formed with a hollowed portion.

5. The weight-adjustable kettle-shaped dumbbell as claimed in claim 4, wherein the hollowed portion is provided with a conical member in a reverse cone shape.

6. The weight-adjustable kettle-shaped dumbbell as claimed in claim 1, wherein each of the selection boards is provided with a resilient member close to one side of a relative slot.

7. The weight-adjustable kettle-shaped dumbbell as claimed in claim 1, wherein a bottom plate is provided under the linking member, the bottom plate being formed with a number of recesses around a circular edge thereof, a circular lid being provided in the body, the circular lid having a number of protrusions corresponding to the recesses.

8. The weight-adjustable kettle-shaped dumbbell as claimed in claim 1, wherein the body is coupled to a base, the base having a selection portion, the selector unit proceeding to select in relation to the base.

9. The weight-adjustable kettle-shaped dumbbell as claimed in claim 1, wherein the selector unit selects the weight pieces from an edge of the weight pieces.

10. The weight-adjustable kettle-shaped dumbbell as claimed in claim 1, wherein the selector unit selects the weight pieces by inserting through the weight pieces.

* * * * *